US008178824B2

(12) United States Patent
Choi et al.

(10) Patent No.: US 8,178,824 B2
(45) Date of Patent: May 15, 2012

(54) COOKING DEVICE

(75) Inventors: Heung Shik Choi, Seoul (KR); Hyun Jung Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 1238 days.

(21) Appl. No.: 11/976,352

(22) Filed: Oct. 24, 2007

(65) Prior Publication Data

US 2008/0105675 A1 May 8, 2008

(30) Foreign Application Priority Data

Oct. 27, 2006 (KR) ..... 10-2006-0104882

(51) Int. Cl.
*H05B 6/72* (2006.01)

(52) U.S. Cl. ..... 219/749; 219/748; 219/751; 126/21 A

(58) Field of Classification Search ..... 219/749, 219/400, 401, 681, 725, 679, 398, 399, 748, 219/751; 126/21 A, 273 R, 19 R, 21 R, 4, 126/39 C, 20; 428/422, 447; 99/476, 395; 426/523

See application file for complete search history.

(56) References Cited

U.S. PATENT DOCUMENTS

| | | | | |
|---|---|---|---|---|
| 4,516,012 | A * | 5/1985 | Smith et al. | 219/400 |
| 4,940,869 | A * | 7/1990 | Scholtes et al. | 219/681 |
| 6,900,424 | B2 * | 5/2005 | Arntz et al. | 219/746 |
| 2005/0230385 | A1 | 10/2005 | Lee et al. | |
| 2006/0225727 | A1 | 10/2006 | Kim et al. | |
| 2006/0237425 | A1 | 10/2006 | Kim et al. | |
| 2008/0076379 | A1 * | 3/2008 | Li | 455/344 |

* cited by examiner

*Primary Examiner* — Quang Van

(74) *Attorney, Agent, or Firm* — Birch, Stewart, Kolasch & Birch, LLP

(57) ABSTRACT

A cooking device that cooks food and drink by using heat generation of a heater, or a heat source such as microwaves. A cooking device is provided in which the radiation of microwaves can be varied depending on load, such as cooking objects, when microwaves are used as a heat source. The cooking device includes a stirring shaft provided to rotate within a cooking chamber, a stirring shaft power source to rotate the stirring shaft, and a stirring vane coupled to the stirring shaft through a hinge unit and configured to rotate by a centrifugal force according to a rotation speed of the stirring shaft. The radiation of microwaves can be varied depending on a load such as a cooking object, and a cooking device having an optimized performance can be provided.

19 Claims, 10 Drawing Sheets

(A)

(B)

COOKING DEVICE

CROSS REFERENCE TO RELATED APPLICATIONS

The present disclosure relates to subject matter contained in priority Korean Patent Application No. 10-2006-0104882, filed on Oct. 27, 2006, the entire contents of which are hereby expressly incorporated by reference.

BACKGROUND OF THE INVENTION

1. Field of the Invention

The present invention relates to a cooking device for cooking food and drink by using heat generation of a heater, a heat source such as microwaves, or the like. More particularly, the present invention relates to a cooking device in which the radiation of microwaves can be varied depending on load, such as cooking objects, when microwaves are used as a heat source.

2. Discussion of Related Art

In general, a cooking device is used to cook food and drink, cooking objects, which are contained in a cooking chamber, by using heat generation of a heater or a heat source such as microwaves.

This cooking device generally includes a stirrer for uniformly distributing microwaves so that food and drink can be heated rapidly and uniformly when a heat source such as microwaves is used.

However, considering that the condition of the radiation of the microwaves is an important factor not only in the intensity of the microwaves, but also in the phase thereof, there is a limit to the implementation of an optimal cooking mode as well as uniform heating according to various conditions of a load depending on the type of a load, the location of a load, and the like, because the stirrer rotates in two dimensions or makes tracking movements in two dimensions.

SUMMARY OF THE INVENTION

Accordingly, an embodiment of the present invention is directed to provide a cooking device in which stirring vanes to stir microwaves radiated from a cooking chamber are rotated around a virtual axis vertical to a stirring shaft while being rotated together with the stirring shaft, causing a radiation condition of microwaves to be varied depending on a load such as cooking objects and implementing an optimal cooking mode according to a load of various conditions.

An aspect of the present invention includes a cooking device, including a stirring shaft provided to rotate within a cooking chamber; a stirring shaft power source that rotates the stirring shaft about a rotational axis; and a stirring vane coupled to the stirring shaft through a hinge unit and configured to rotate by centrifugal force according to a rotation speed of the stirring shaft. In a further aspect of the present invention, the hinge unit is configured to couple the stirring shaft and the stirring vane so that the stirring vane can rotate about an axis perpendicular to the rotational axis of the stirring shaft. Further, the hinge unit is provided such that the stirring vane is inserted into the stirring shaft; and the hinge unit further includes a hinge pin configured to allow the stirring vane to rotate integrally with the stirring shaft. Further, the hinge unit further includes a hinge loop latched to the stirring shaft and inserted into the stirring vane so that the stirring vane is rotated by centrifugal force. The hinge unit further includes a hinge stopper that supports the stirring vane against the force of gravity acting on the stirring vane.

In a further aspect of the present invention, the hinge unit has one side coupled to the stirring shaft and the other side coupled to the stirring vane, and the hinge unit further includes a hinge resilient member configured to support the stirring vane against the force of gravity acting on the stirring vane. Further, one or more stirring vanes are coupled to one stirring shaft. A plurality of stirring vanes may be radially coupled to one stirring shaft. In a further aspect of the present invention, the mass of a distal portion of the stirring vane not coupled to the hinge unit is greater than the mass of a proximal portion of the stirring vane coupled to the hinge unit. The stirring vane may further include a base coupled to the hinge unit; and a weight provided at a portion far from the stirring shaft. The stirring vane may further include material that can receive microwaves and radiate the microwaves; and the material included in the stirring vane includes metal.

A further aspect of the present invention provides a cooking chamber to contain and cook food and drink; a magnetron that generates microwaves supplied to the cooking chamber; a waveguide that induces the microwaves to the cooking chamber; a stirring shaft having one end coupled to the waveguide and another end provided within the cooking chamber; a stirring shaft power source that rotates the stirring shaft; and a stirring vane provided within the cooking chamber and coupled to the stirring shaft through a hinge unit so that the stirring vane can be rotated by centrifugal force according to a rotation speed of the stirring shaft.

In a further aspect of the present invention, a stirring space where the stirring vane can be rotated is partitioned within the cooking chamber, and the stirring vane is positioned within the stirring space. Further, the stirring space is shielded by a barrier so that the stirring vane can be protected from food and drink or heat within the cooking chamber. The barrier includes a material through which microwaves can pass; and the material of the barrier includes mica.

BRIEF DESCRIPTION OF THE DRAWINGS

The above, and other objects, features, and advantages of the present invention will be made apparent from the following description of the preferred embodiments, given as non-limiting examples, with reference to the accompanying drawings in which.

DETAILED DESCRIPTION OF THE INVENTION

The present invention will now be described in detail in connection with specific embodiments with reference to the accompanying drawings. The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description is taken with the drawings making apparent to those skilled in the art how the forms of the present invention may be embodied in practice.

Figure 1:
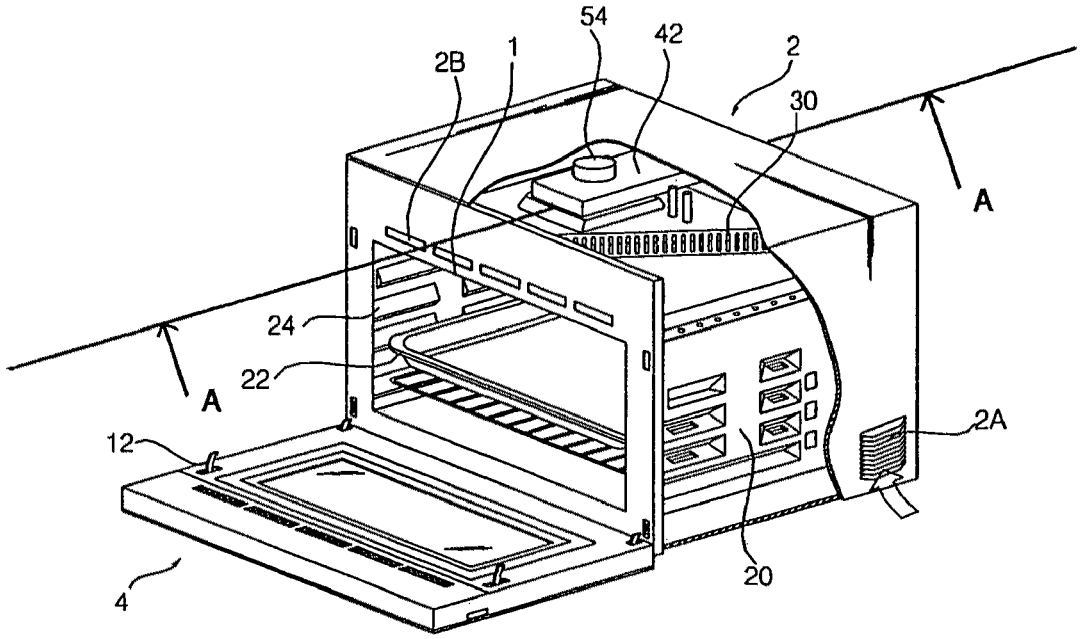
FIG. 1 is a perspective view illustrating a partially cut away exterior of a cooking device in accordance with a first embodiment of the present invention.
Figure 2:
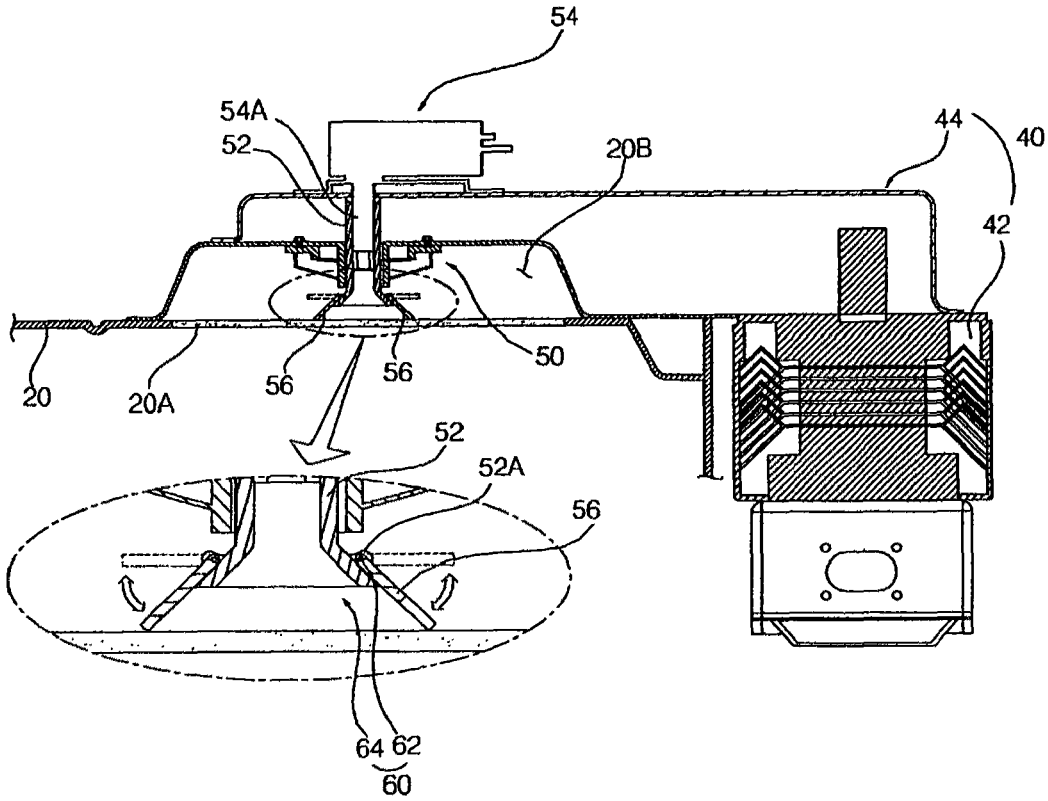
FIG. 2 is a cross-sectional view of the cooking device taken along line A-A of FIG. 1.
Figure 3:
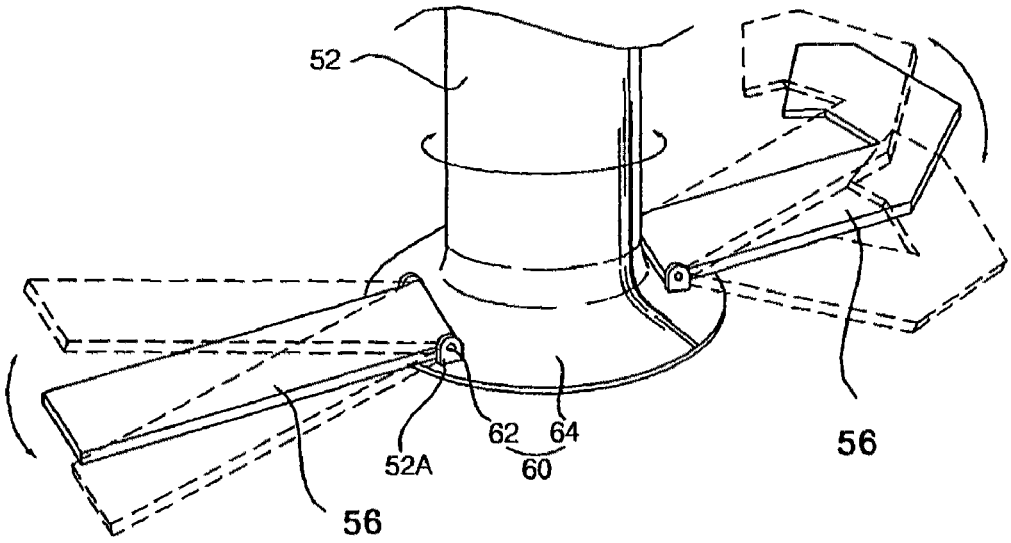
FIG. 3 is a perspective view illustrating a part of a stirring unit of the cooking device of FIG. 2.

FIG. 1 is a perspective view illustrating a partially cut away exterior of a cooking device in accordance with a first embodiment of the present invention. FIG. 2 is a cross-sectional view of the cooking device taken along line A-A of FIG. 1. FIG. 3 is a perspective view illustrating a part of a stirring unit of the cooking device in accordance with the first embodiment of the present invention.

The cooking device in accordance with the first embodiment of the present invention may have an outer appearance in which a cabinet 2, a door 4 is provided to open and close the cabinet 2, and a control panel (not shown) is provided in the cabinet 2 or the door 4, and enabling a user to input an operation of the cooking device or view a current operating condition of the cooking device.

The cabinet 2 has a cabinet inlet port 2A formed on one side and cabinet outlet ports 2B formed on the other side. The cabinet inlet port 2A allows external air to enter the cabinet 2 so that the interior of the cabinet 2 is cooled by air. The cabinet outlet ports 2B allow air, which has cooled the cabinet 2, to be exhausted outside the cabinet 2.

The door 4 may be configured to move up and down, and may be coupled to the cabinet 2 via a hinge so as to rotated about the hinge to open and close. The door 4 may also be coupled to the cabinet 2 through door latches 12 to lock the door 4 closed and to release the locking of the door 4.

The control panel may be integrally formed with the door 4. The control panel may include a variety of input units to input operations of the cooking device according to the present invention, such as locking and releasing the door latches 12 and determining whether a cooking chamber heat source operates, and various display units for displaying current conditions of the cooking device according to the present invention, or the like.

The interior of the cooking device in accordance with a first embodiment of the present invention is described below. Within the cabinet 2 is provided a cooking chamber 20. The cooking chamber 20 is opened and closed by the door 4, and cooks food and drink contained therein. A rack 22 on which food and drink are placed may be provided within the cooking chamber 20. Furthermore, rack rails 24 by which the rack 22 can be removable may be provided on left and right inner side walls of the cooking chamber 20. The edges of the rack 22 can be inserted into and removed from the rack rails 24 in forward and rearward directions. A plurality of pairs of rack rails 24 may be provided on the left and right inner side walls of the cooking chamber 20 along the vertical direction so that the height of the rack 22 within the cooking chamber 20 can be controlled and adjusted.

A cooking chamber heat source for heating the interior of the cooking chamber 20 is also provided within the cabinet 2. That is, the cooking chamber heat source may include a heater 30 heated by electricity and configured to raise air temperature within the cooking chamber 20. Alternatively, the cooking chamber heat source may include a microwave supply unit 40 that supplies microwaves to the cooking chamber 20 so that food and drink are heated and cooked by microwaves.

The microwave supply unit 40 may include a magnetron 42 that generates microwaves to be supplied to the cooking chamber 20, and a waveguide 44 that induces or guides microwaves, generated from the magnetron 42, to the cooking chamber 20. The waveguide 44 has one side communicating with the magnetron 42, and the other side communicating with the cooking chamber 20. The magnetron 42 and the waveguide 44 may be provided outside the cooking chamber 20.

Furthermore, in the event that microwaves are supplied to the cooking chamber 20, a stirring unit 50 that stirs the microwaves supplied to the cooking chamber 20 may be arranged within the cabinet 2, so that food and drink within the cooking chamber 20 can be cooked rapidly and uniformly.

The stirring unit 50 may include a stirring shaft 52 rotatably provided in the cooking chamber 20, a stirring shaft power source 54 coupled to the stirring shaft 52 and configured to rotate the stirring shaft 52, stirring vanes 56 rotatably provided within the cooking chamber 20, and a hinge unit 60 which forces the stirring vanes 56 to rotate together with the stirring shaft 52 and couples the stirring vanes 56 and the stirring shaft 52 to allow the stirring vanes 56 to rotate about respective axes perpendicular to the stirring shaft 52, by the centrifugal force depending on the rotation speed of the stirring shaft 52.

The stirring shaft 52 may be placed anywhere within the cooking chamber 20. Hereinafter, in the present embodiment, it is assumed that the stirring shaft 52 is placed in the upper side of the cooking chamber 20. The stirring shaft 52 may be provided anywhere (that is, up and down, left and right, and front and rear). Hereinafter, in the present embodiment, it is assumed that the stirring shaft 52 is positioned approximately vertically. The stirring shaft 52 may be formed of a material, such as metal, from which microwaves can be radiated such that microwaves induced or directed to the cooking chamber 20 by the waveguide 44 can be radiated to the cooking chamber 20 through the stirring shaft 52. One end of the stirring shaft 52, to which the stirring vanes 56 are not coupled, is coupled to the waveguide 44. In other words, when the stirring shaft 52 is placed in the upper side of the cooking chamber 20 as in the present embodiment, the top end of the stirring shaft 52 may be inserted into the waveguide 44 and coupled thereto. The stirring shaft 52 may have a hollow structure. The number of stirring shafts 52 may be one or two or more. Hereinafter, in the present embodiment, the device includes one stirring shaft 52.

The stirring shaft power source 54 may be implemented by using one of various kinds of motive powers that can generate motive power, such as a motor. Hereinafter, in the present embodiment, it is assumed that the stirring shaft power source 54 is implemented by using a motor, and the stirring shaft power source 54 may also be referred to as a stirring shaft motor 54.

Alternatively, the stirring shaft motor 54 may be placed within the cooking chamber 20 or outside the cooking chamber 20. The stirring shaft power source 54 may be coupled to the stirring shaft 52 directly or through a motive power transfer unit, such as a belt and pulley or a gear set.

Hereinafter, in the present embodiment, it is assumed that the stirring shaft motor 54 is provided outside the cooking chamber 20, in particular, in the upper side of the waveguide 44, and a rotary shaft 54A of the stirring shaft motor 54 is inserted into the waveguide 44 and then directly coupled to the stirring shaft 52.

The rotary shaft 54A of the stirring shaft motor 54 may be fitted into the stirring shaft 52. The rotary shaft 54A of the stirring shaft motor 54 may be formed of a nonmetallic material so that microwaves are not induced or guided thereto. The stirring shaft motor 54 may be constructed to have its speed vary such that the stirring shaft 52 can rotate at various rates.

The stirring vanes 56 may be placed in a stirring space 20B. The stirring space 20B may extend upwardly from the cooking chamber 20 on one upper side of the cooking chamber 20. The stirring space 20B may be covered with a barrier 20A for protecting the stirring unit 50 from remnants of food and drink generated within the cooking chamber 20 and/or hot air within the cooking chamber 20. The stirring space 20B may be formed of a material through which microwaves can pass.

The barrier 20A may be formed of any material through which microwaves can pass. One of the materials may include mica. The stirring vanes 56 may be formed of a material, such as metal from which microwaves can be radiated.

One stirring vane 56 may be coupled to one stirring shaft 52, or two or more stirring vanes 56 may be coupled to one stirring shaft 52. When a plurality of the stirring vanes 56 are coupled to one stirring shaft 52, they may be radially arranged uniformly along the cylinder direction of the stirring shaft 52. Further, when the plurality of stirring vanes 56 are coupled to one stirring shaft 52, they may be constructed in even numbers or odd numbers. When the stirring vanes 56 are coupled to one stirring shaft 52 in even numbers, they may be constructed symmetrically in a radial direction of the stirring shaft 52. When the plurality of stirring vanes 56 are coupled to one stirring shaft 52, they may have the same shape or different shapes. Hereinafter, in the present embodiment, it is assumed that two stirring vanes 56 are coupled to one stirring shaft 52 and opposite to each other in a radial direction of the stirring shaft 52, and have different shapes.

The hinge unit 60 may include hinge pins 62 for allowing the stirring vanes 56 to rotate about respective axes perpendicular to the stirring shaft 52. The hinge pins 62 are inserted into the stirring vanes 56, respectively, and are integrally coupled with the stirring shaft 52 rotatably. The hinge pin 62 may also be inserted into the stirring shaft 52 through the stirring shaft 52, or may be inserted into a hinge boss 52A provided outside the stirring shaft 52 or in a hinge stoppers 64 integrated with the stirring shaft 52.

Furthermore, the hinge unit 60 is provided in the stirring shaft 52 or the stirring vanes 56 such that the stirring vanes 56 can be rotated more easily by the centrifugal force. Thus, when the weight of the stirring vanes is greater than the centrifugal force according to the rotation of the stirring shaft, the hinge unit 60 may include the hinge stoppers 64 for supporting the stirring vanes 52 to be in equilibrium with the gravitational force of the stirring vanes 56.

The hinge stoppers 64 may be constructed to limit a downward rotational range of the stirring vanes 56 so that the stirring vanes 56 are supported so as not to extend in the same direction as that along which the stirring shaft 52 extends. Without the support of the hinge stoppers 64, the stirring vanes 56 would extend substantially vertically due to their own weight.

Thus, the hinge stoppers 64 may be provided underneath the stirring vanes 56 and may extend at a specific angle upwardly from the stirring shaft 52 with respect to the axial direction of the stirring shaft 52, as in the present embodiment. That is, the hinge stoppers 64 may have a skirt shape.

An operation of the cooking device constructed above according to the present embodiment is described below in detail.

If a user opens the door 4, places food and drink to cook in the cooking chamber 20, closes the door 4, and then manipulates the control panel 6 to operate a cooking mode, at least one of the heater 30 and the microwave supply unit 40 (that is, several cooking chamber heat sources) is operated according to cooking information input by the user through control of the control panel 6, a preset algorithm or the like.

If the heater 30 operates, a temperature within the cooking chamber 20 rises due to generation of heat of the heater 30, so that the food and drink within the cooking chamber 20 can be cooked by the heat.

Alternatively, if the microwave supply unit 40 operates, the microwaves are infiltrated into the food and drink within the cooking chamber 20, so that the food and drink within the cooking chamber 20 can be cooked by the infiltrated microwaves. At this time, if the microwave supply unit 40 operates, the stirring unit 50 can also operate. In this case, the stirring shaft 52 and the stirring vanes 56 may be rotated or have their rotation stopped by controlling the rotation speed of the stirring shaft 52. Further, when the stirring shaft 52 and the stirring vanes 56 are rotated, the stirring vanes 56 can be rotated about respective axes perpendicular to the stirring shaft 52 by the centrifugal force according to the rotation speed of the stirring shaft 52. The rotation speed of the stirring shaft 52 may be controlled in various ways based on cooking information input through the control panel 6, positional information about a cooking object within the cooking chamber 20 or the like.

When the stirring vanes 56 are rotated about respective axes perpendicular to the stirring shaft 52 as described above, if a relatively greater centrifugal force than the weight of the stirring vanes induced by rotation of the stirring shaft operates on the stirring vanes 56, the stirring vanes 56 are rotated to a nearly horizontal position. However, when the rotation speed of the stirring shaft 52 is slow, a relatively small centrifugal force operates on the stirring vanes 56 and the stirring vanes 56 rotate downwardly due to their own weight. Consequently, a radiation condition of the microwaves can be varied by the stirring unit 50 depending on the rotation speed of the stirring shaft 52.

Thus, impedance matching of the microwaves can be varied according to an angle where the stirring vanes 56 are rotated about the respective axes perpendicular to the stirring shaft 52 depending on the rotation speed of the stirring shaft 52 controlled according to a load such as a cooking object, and consequently unnecessary leakage of the microwaves is prevented, to concentrate the microwaves on the load, or to distribute the microwaves uniformly in the cooking chamber 20, thus to provide optimal cooking efficiency in cooking chamber.

Furthermore, if the angle of rotation of the stirring vanes 56 about the respective axes perpendicular to the stirring shaft 52 is varied, a phase of microwaves (E-field) within the cooking chamber 20 is also changed, so that the microwaves in the cooking chamber 20 are changed randomly. Thus, the microwaves can be radiated uniformly within the cooking chamber 20, and a cooking object can be heated uniformly anywhere within the cooking chamber 20.

Figure 13:
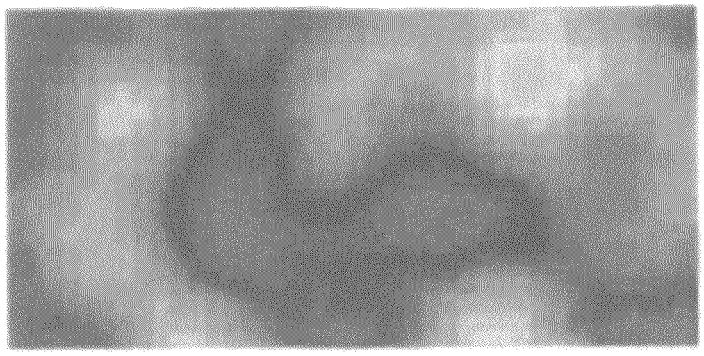
FIG. 13A is a view illustrating microwave distribution according to the present invention in which the stirring vanes are rotated together with the stirring shaft and while rotating about respective axes perpendicular to the stirring shaft.
FIG. 13B is a view illustrating microwave distribution according to a comparative example in which the stirring vanes are rotated together with the stirring shaft, but are not rotated about respective axes perpendicular to the stirring shaft.
Figure 13:
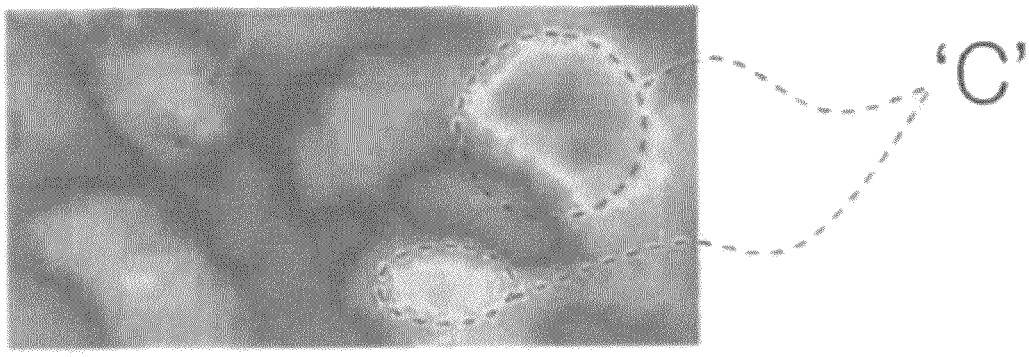

The uniform radiation effect of microwaves according to the present embodiment can be understood from FIGS. 13A and 13B. FIG. 13A illustrates the cooking device according to the present invention. FIG. 13A illustrates a microwave distribution state within the cooking chamber 20 when the stirring vanes 56 are rotated together with the stirring shaft 52 and while rotating about the respective axes perpendicular to the stirring shaft 52. FIG. 13B shows an example, which can be compared with the cooking device of the present invention, and illustrates a microwave distribution state within the cooking chamber 20 when the stirring vanes 56 are rotated together with the stirring shaft 52, but while not rotating about respective axes perpendicular to the stirring shaft 52. From FIGS. 13A and 13B, it can be seen that as indicated by red colors in FIG. 13B, cold points C where the microwaves are not transferred sufficiently are very wide, whereas in FIG. 13A, cold points rarely exist and the microwaves are distributed almost uniformly.

Figure 4:
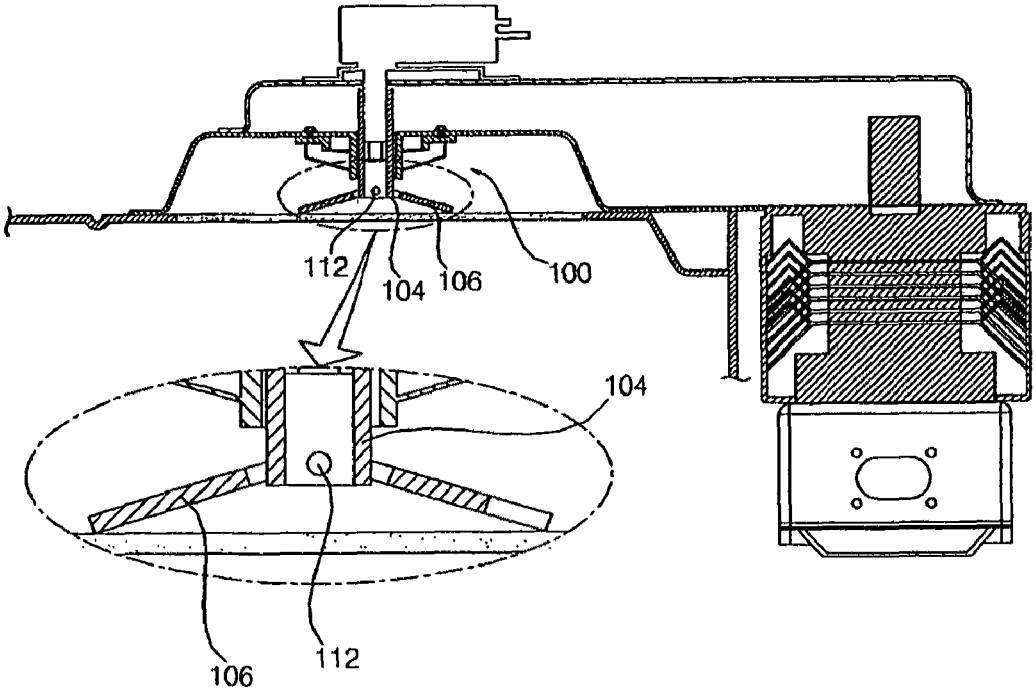
FIG. 4 is a cross-sectional view of a cooking device in accordance with a second embodiment of the present invention.
Figure 5:
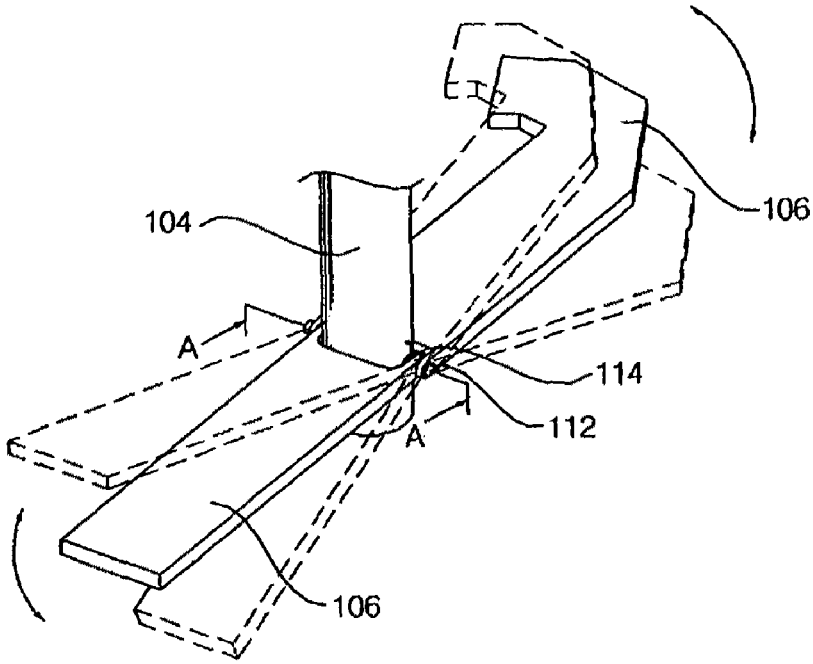
FIG. 5 is a perspective view illustrating a part of a stirring unit of the cooking device of FIG. 4.
Figure 6:
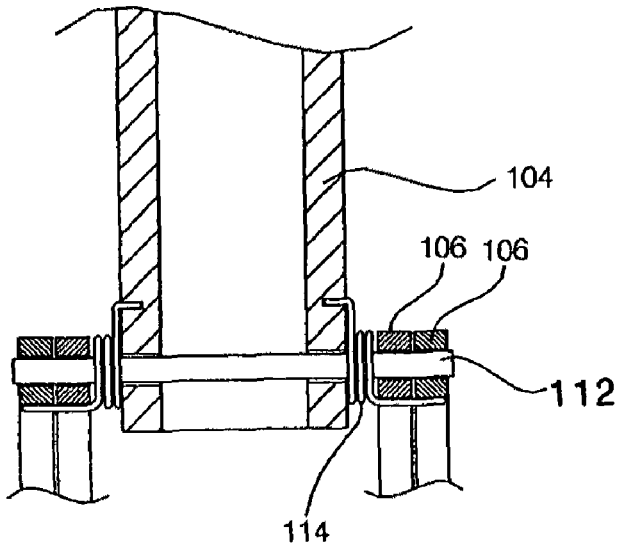
FIG. 6 is a cross-sectional view of the cooking device taken along line A-A of FIG. 5.

FIG. 4 is a cross-sectional view of integral portions of a cooking device in accordance with a second embodiment of the present invention. FIG. 5 is a perspective view illustrating a part of a stirring unit of the cooking device in accordance with a second embodiment of the present invention. FIG. 6 is a cross-sectional view of the cooking device taken along line A-A of FIG. 5.

The construction and operation of the cooking device according to the present embodiment are the same as those of the cooking device in accordance with the above-described first embodiment of the present invention except for a stirring unit and description thereof will be omitted in order to avoid redundancy.

A stirring unit 100 of the cooking device according to the present embodiment includes a stirring shaft 104, which can be rotated by motive power of a stirring shaft power source, and stirring vanes 106 coupled to the stirring shaft 104 through a hinge pin 112.

The number of the stirring vanes 106 may be one, or may be more than one.

The hinge unit 110 may include the hinge pin 112, having one side inserted into the stirring shaft 104 and the other side fit into the stirring vanes 106, and a hinge resilient member 114 having one side coupled to the stirring shaft 104 and the other side coupled to the stirring vanes 106. The hinge resilient member 114 causes the stirring vanes 106 to be positioned substantially diagonally and rotated from a vertical position and opposes the force of gravity on the stirring vanes 106, by elastic force.

The hinge pin 112 can penetrate the stirring shaft 104 approximately in a radial direction of the stirring shaft 104. The hinge pin 112 may have both ends, which penetrate the stirring shaft 104, inserted into the stirring vanes 106, respectively.

The hinge resilient member 114 may be implemented by using a coil spring, a spiral spring or a plate spring. Alternatively, the hinge resilient member 114 may be implemented in various ways within the technical spirit of the present invention. Hereinafter, in the present embodiment, it is assumed that the hinge resilient member 114 is implemented by using a spiral spring.

The number of the hinge resilient member 114 may be one, or two or more. Hereinafter, in the present embodiment, it is assumed that the number of the hinge resilient member 114 is two and the two hinge resilient members 114 are spaced apart from each other in a length direction of the hinge pin 112 so that they can resiliently support the stirring vanes 106 firmly.

The hinge resilient members 114 are respectively wound at both ends of the hinge pin 112 that penetrates the stirring shaft 104, and respectively have one end fixed to the stirring shaft 104 and the other end disposed at the bottom of the stirring vanes 106 so that they can be fixed to the stirring vanes 106.

An operation of the stirring unit 100 constructed above according to the present embodiment is described below.

If the rotation speed of the stirring shaft 104 is fast, the stirring vanes 106 are placed almost horizontally. If the rotation speed of the stirring shaft 104 is slow or the stirring shaft 104 does not rotate, the stirring vanes 106 go down. At this time, when the stirring vanes 106 go down, the stirring vanes 106 are resiliently supported by the hinge resilient members 114, so that they are positioned substantially diagonally Accordingly, if the rotation speed of the stirring shaft 104 becomes fast, the stirring vanes 106 can be disposed almost horizontally by the centrifugal force.

Figure 7:
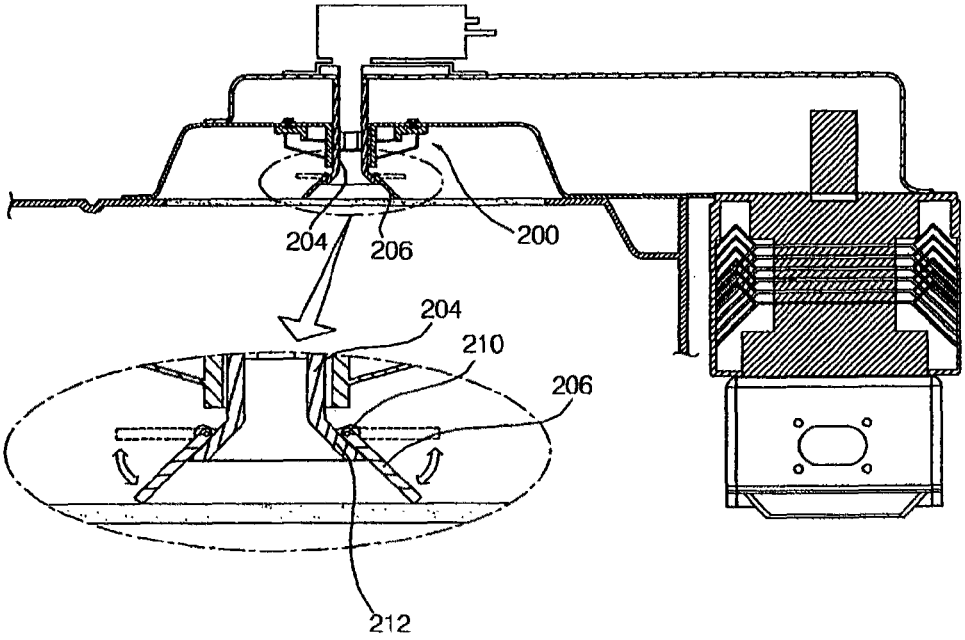
FIG. 7 is a cross-sectional view of a cooking device in accordance with a third embodiment of the present invention.
Figure 8:
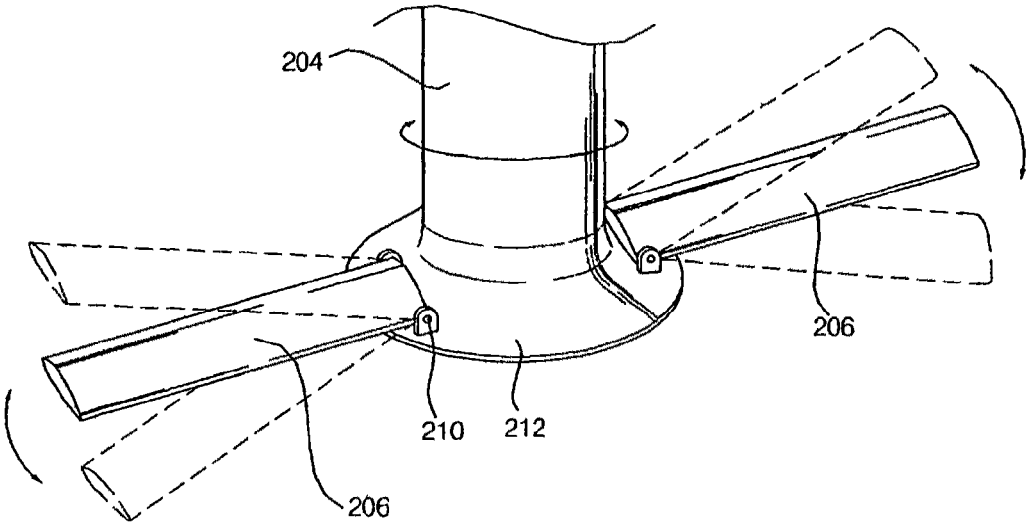
FIG. 8 is a perspective view illustrating a part of a stirring unit of the cooking device of FIG. 7.

FIG. 7 is a cross-sectional view of integral portions of a cooking device in accordance with a third embodiment of the present invention. FIG. 8 is a perspective view illustrating a part of a stirring unit of the cooking device in accordance with a third embodiment of the present invention;

A construction and operation of the cooking device according to the present embodiment are the same as those of the cooking device in accordance with the above-described first embodiment of the present invention except for a stirring unit and description thereof will be omitted in order to avoid redundancy.

A stirring unit 200 of the cooking device according to the present embodiment may include a stirring shaft 204 that can be rotated by motive power of a stirring shaft power source, stirring vanes 206, hinge pins 210 that hinge couple the stirring vanes 206 and the stirring shaft 204 so that the stirring vanes 206 can be rotated together with the stirring shaft 204 and can be rotated about respective axes perpendicular to the stirring shaft 204, and hinge stoppers 212 formed below the stirring vanes 206 and disposed in the stirring shaft 204.

The stirring vanes 206 may have a streamlined cross section, and therefore can be easily rotated about the respective axes perpendicular to the stirring shaft 204 by the centrifugal force depending on the rotation speed of the stirring shaft 204.

As described above, in the stirring unit 200 according to the present embodiment, the stirring vanes 206 can be rotated about respective axes perpendicular to the stirring shaft 204 according to the rotation speed of the stirring shaft 204.

Figure 9:
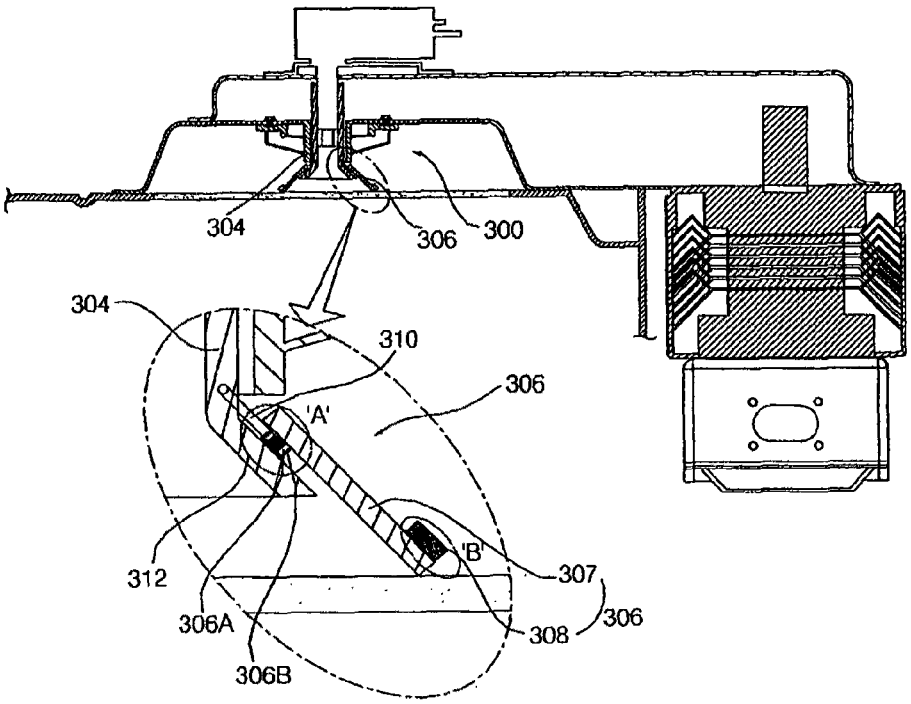
FIG. 9 is a cross-sectional view of a cooking device in accordance with a fourth embodiment of the present invention.
Figure 10:
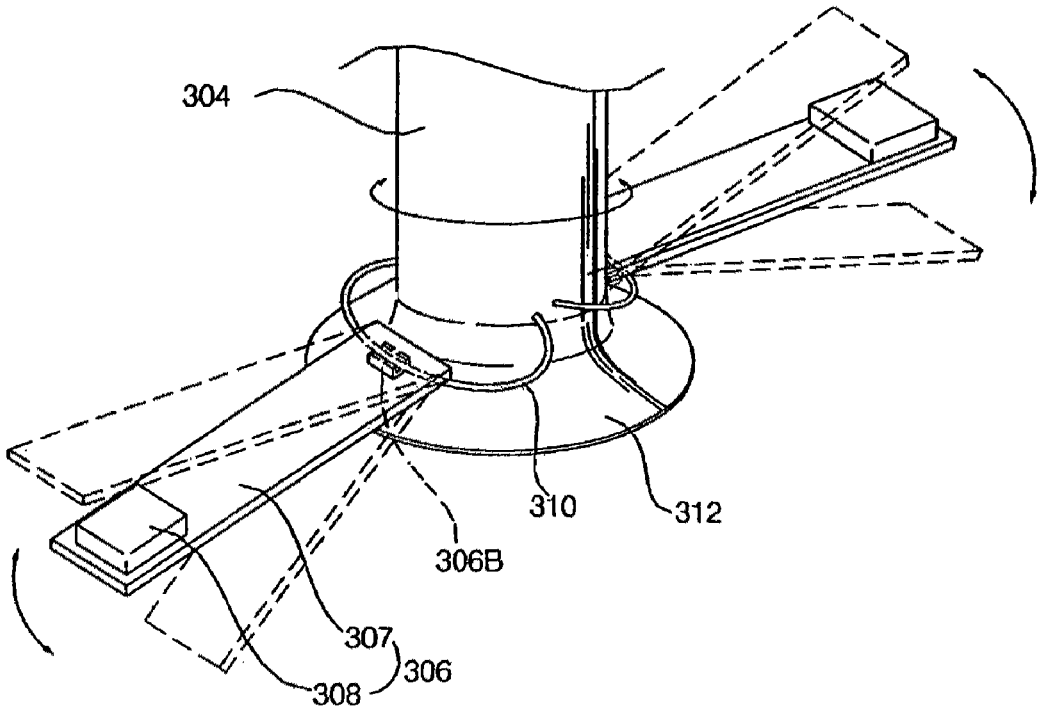
FIG. 10 is a perspective view illustrating a part of a stirring unit of the cooking device of FIG. 9.

FIG. 9 is a cross-sectional view of integral portions of a cooking device in accordance with a fourth embodiment of the present invention. FIG. 10 is a perspective view illustrating a part of a stirring unit of the cooking device in accordance with a fourth embodiment of the present invention.

A construction and operation of the cooking device according to the present embodiment are the same as those of the cooking device in accordance with the above-described first embodiment of the present invention except for a stirring unit and description thereof will be omitted in order to avoid redundancy.

A stirring unit 300 of the cooking device according to the present embodiment may include a stirring shaft 304 that can be rotated by motive power of a stirring shaft power source, stirring vanes 306, hinge loops 310 for hinging the stirring vanes 306 and the stirring shaft 304 so that the stirring vanes 306 can be rotated together with the stirring shaft 304 and can be rotated about respective axes perpendicular to the stirring shaft 304, and hinge stoppers 312 formed under the stirring vanes 306 and disposed in the stirring shaft 304.

A hinge boss 306B having a hinge hole 306A formed therein may be provided below the stirring vanes 306 so that the hinge loop 310 can be inserted into the hinge boss 306B.

In each stirring vane 306, a distal portion 'B' not coupled to a hinge unit (in particular, the hinge loop 310) in a direction where it is far from the stirring shaft 304 has mass greater than that of a proximal portion 'A' coupled to the hinge loop 310. Thus, the stirring vanes 306 can be easily rotated about respective axes perpendicular to the stirring shaft 304 by the centrifugal force depending on the rotation speed of the stirring shaft 304. That is, for example, the stirring vane 306 may include a base 307 coupled to a hinge unit (in particular, the hinge loop 306), and a weight 308 having a predetermined mass and disposed at a portion where it is far from the stirring shaft 304.

The hinge loop 310 may have one end inserted into the hinge hole 306A, thus penetrating the hinge boss 306B, and both ends inserted into the stirring shaft 304.

As described above, in the stirring unit 300 according to the present embodiment, the stirring vanes 306 are rotated about respective axes perpendicular to the stirring shaft 304 according to the rotation speed of the stirring shaft 304.

Figure 11:
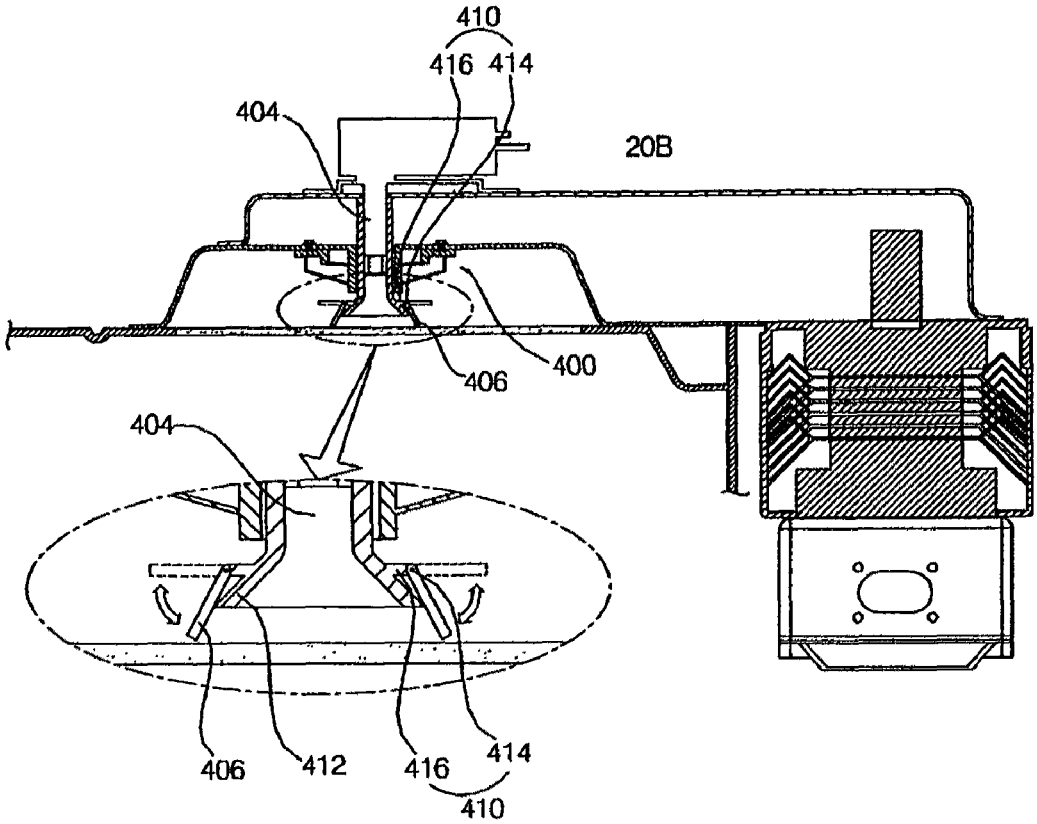
FIG. 11 is a cross-sectional view of a cooking device in accordance with a fifth embodiment of the present invention.
Figure 12:
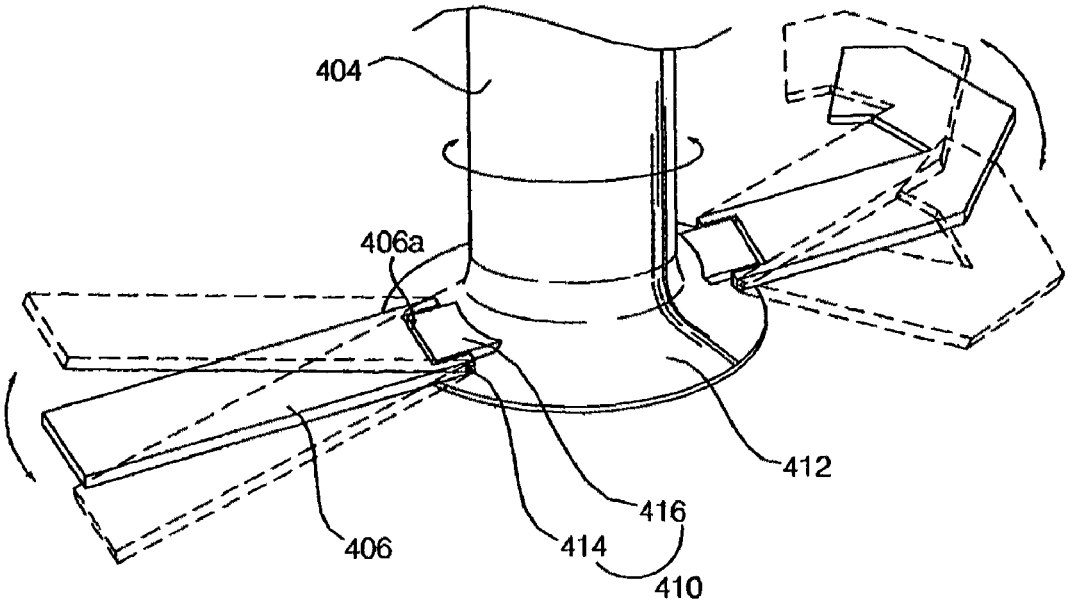
FIG. 12 is a perspective view illustrating a part of a stirring unit of the cooking device of FIG. 11.

FIG. 11 is a cross-sectional view of integral portions of a cooking device in accordance with a fifth embodiment of the present invention. FIG. 12 is a perspective view illustrating a part of a stirring unit of the cooking device in accordance with a fifth embodiment of the present invention.

A construction and operation of the cooking device according to the present embodiment are the same as those of the cooking device in accordance with the above-described first embodiment of the present invention except for a stirring unit and description thereof will be omitted in order to avoid redundancy.

A stirring unit 400 of the cooking device according to the present embodiment may include a stirring shaft 404, which can be rotated by motive power of a stirring shaft power source and includes projections 416, stirring vanes 406 respectively having a concave portion 406*a* hinged to each projection 416, a hinge unit 410 including a hinge pin 414 and a projection 416 for hinging the stirring vanes 406 and the stirring shaft 404 so that the stirring vanes 406 can be rotated together with the stirring shaft 404 and also rotated about respective axes perpendicular to the stirring shaft 404, and hinge stoppers 412 disposed below the stirring vanes 406 and formed in the stirring shaft 404. The projection 416 has formed therein a hole into which a pin can be inserted. In the present embodiment, when the centrifugal force acting on the stirring vanes 406 is smaller than the weight of the stirring vanes 406, there is an advantage that the position of the stirring vane can be controlled according to the length of the projection 406 formed in the stirring shaft 404. In addition, the present embodiment improves working performance when coupling the stirring vanes 406 to the stirring shaft 404.

In the cooking device constructed and operated as described above according to the present invention, the stirring shaft and the stirring vanes are coupled through the hinge unit and the stirring vanes can be rotated about respective axes perpendicular to the stirring shaft while rotating together with the stirring shaft, so that radiation conditions of microwaves can be varied in various ways. Accordingly, there are advantages in that not only uniform heating, but also concentrated heating depending on various conditions are possible, and an optimal cooking mode can be implemented according to loads of various conditions.

Furthermore, the cooking device according to the present invention includes the hinge stoppers or the hinge resilient member for allowing the stirring vanes to be in equilibrium with gravity even when the stirring shaft is rotated slowly or not rotated. Thus, when the stirring shaft is rotated rapidly, the stirring vanes can be rotated more easily about respective axes perpendicular to the stirring shaft by the centrifugal force according to the rotation speed of the stirring shaft.

Furthermore, the cooking device according to the present invention includes the stirring vane in which a distal portion not coupled to the hinge unit thereof has mass greater than that of a proximal portion coupled to the hinge unit thereof. Accordingly, there is an advantage in that the stirring vanes can be rotated more easily by the centrifugal force according to the rotation speed of the stirring shaft.

While the invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

The foregoing embodiments and advantages are merely exemplary and are not to be construed as limiting the present invention. The present teaching can be readily applied to other types of apparatuses. The description of the present invention is intended to be illustrative, and not to limit the scope of the claims. Many alternatives, modifications, and variations will be apparent to those skilled in the art.

The illustrations of the embodiments described herein are intended to provide a general understanding of the structure of the various embodiments. The illustrations are not intended to serve as a complete description of all of the elements and features of apparatus and systems that utilize the structures or methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. Accordingly, the disclosure and the figures are to be regarded as illustrative rather than restrictive.

One or more embodiments of the disclosure may be referred to herein, individually and/or collectively, by the term "invention" merely for convenience and without intending to voluntarily limit the scope of this application to any particular invention or inventive concept. Moreover, although specific embodiments have been illustrated and described herein, it should be appreciated that any subsequent arrangement designed to achieve the same or similar purpose may be substituted for the specific embodiments shown. This disclosure is intended to cover any and all subsequent adaptations or variations of various embodiments. Combinations of the above embodiments, and other embodiments not specifically described herein, will be apparent to those of skill in the art upon reviewing the description.

The above disclosed subject matter is to be considered illustrative, and not restrictive, and the appended claims are intended to cover all such modifications, enhancements, and other embodiments which fall within the true spirit and scope of the present invention. Thus, to the maximum extent allowed by law, the scope of the present invention is to be determined by the broadest permissible interpretation of the following claims and their equivalents, and shall not be restricted or limited by the foregoing detailed description.

Although the invention has been described with reference to several exemplary embodiments, it is understood that the words that have been used are words of description and illustration, rather than words of limitation. As the present invention may be embodied in several forms without departing from the spirit or essential characteristics thereof, it should also be understood that the above-described embodiments are not limited by any of the details of the foregoing description, unless otherwise specified. Rather, the above-described embodiments should be construed broadly within the spirit and scope of the present invention as defined in the appended claims. Therefore, changes may be made within the metes and bounds of the appended claims, as presently stated and as amended, without departing from the scope and spirit of the invention in its aspects.

What is claimed is:

1. A cooking device, comprising:

a cabinet;

a cooking chamber formed in the cabinet to contain and cook food or drink;

a magnetron configured to generate microwaves which are supplied to the cooking chamber;

a stirring shaft;

a stirring shaft power source that rotates the stirring shaft; and a stirring vane configured to stir the microwaves generated by the magnetron and coupled to the stirring shaft through a hinge unit such that a degree of an angle of the stirring vane with respect to the stirring shaft is varied during rotation by alteration of a centrifugal force according to a rotation speed of the stirring shaft, which adjusts a radiation condition of the microwaves supplied into the cooking chamber.

2. The cooking device of claim 1, wherein the hinge unit is configured to couple the stirring shaft and the stirring vane so that the stirring vane can rotate about an axis perpendicular to a rotational axis of the stirring shaft.

3. The cooking device of claim 2, wherein the hinge unit is provided such that the stirring vane is inserted into the stirring shaft.

4. The cooking device of claim 2, wherein the hinge unit further includes a hinge pin configured to allow the stirring vane to rotate integrally with the stirring shaft.

5. The cooking device of claim 1, wherein the hinge unit further includes a hinge loop latched to the stirring shaft and inserted into the stirring vane so that the stirring vane is rotated by centrifugal force.

6. The cooking device of claim 1, wherein one or more stirring vanes are coupled to one stirring shaft.

7. The cooking device of claim 1, wherein a plurality of stirring vanes are radially coupled to one stirring shaft.

8. The cooking device of claim 1, wherein the mass of a distal portion of the stirring vane not coupled to the hinge unit is greater than the mass of a proximal portion of the stirring vane coupled to the hinge unit.

9. The cooking device of claim 8, wherein the stirring vane further comprises:

a base coupled to the hinge unit; and a weight provided at a portion far from the stirring shaft.

10. The cooking device of claim 1, wherein the stirring vane includes material that can receive microwaves and radiate the microwaves.

11. The cooking device of claim 10, wherein the material included in the stirring vane includes metal.

12. A cooking device, comprising:

a stirring shaft provided to rotate within a cooking chamber;

a stirring shaft power source that rotates the stirring shaft about a rotational axis; and a stiffing vane coupled to the stirring shaft through a hinge unit and configured to rotate by centrifugal force according to a rotation speed of the stirring shaft, wherein the hinge unit further includes a hinge stopper that supports the stirring vane against the force of gravity acting on the stirring vane.

13. The cooking device of claim 12, wherein the hinge stopper is a trumpet-shaped portion formed at an end of the stirring shaft.

14. A cooking device, comprising:

a stirring shaft provided to rotate within a cooking chamber:

a stirring shaft power source that rotates the stirring shaft about a rotational axis; and a stirring vane coupled to the stirring shaft through a hinge unit and configured to rotate by centrifugal force according to a rotation speed of the stirring shaft, wherein:

the hinge unit has one side coupled to the stirring shaft and the other side coupled to the stirring vane, and the hinge unit further includes a hinge resilient member configured to support the stirring vane against the force of gravity acting on the stirring vane.

15. A cooking device comprising:

a cooking chamber to contain and cook food and drink;

a magnetron configured to generate microwaves supplied to the cooking chamber;

a waveguide that induces the microwaves to the cooking chamber;

a stirring shaft having one end coupled to the waveguide and another end provided within the cooking chamber;

a stirring shaft power source that rotates the stirring shaft; and a stirring vane configured to stir the microwaves generated by the magnetron and coupled to the stirring shaft through a hinge unit such that a degree of an angle of the stirring vane with respect to the stirring shaft is varied during rotation by alteration of a centrifugal force according to a rotation speed of the stirring shaft, which adjusts a radiation condition of the microwaves supplied into the cooking chamber.

16. The cooking device of claim 15, wherein:

a stirring space where the stirring vane can be rotated is partitioned within the cooking chamber, and wherein the stirring vane is positioned within the stirring space.

17. The cooking device of claim 16, wherein the stirring space is shielded by a barrier so that the stirring vane can be protected from food and drink or heat within the cooking chamber.

18. The cooking device of claim 17, wherein the barrier includes a material through which microwaves can pass.

19. The cooking device of claim 18, wherein the material of the barrier includes mica.

* * * * *